US007395613B2

(12) United States Patent
Schoenborn et al.

(10) Patent No.: US 7,395,613 B2
(45) **Date of Patent: *Jul. 8, 2008**

(54) FOOTWEAR SOLE

(75) Inventors: Mary L. Schoenborn, Rockford, MI (US); Donald R. Reardon, Portland, OR (US)

(73) Assignee: Wolverine World Wide, Inc., Rockford, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/465,281

(22) Filed: Aug. 17, 2006

(65) Prior Publication Data

US 2006/0283047 A1 Dec. 21, 2006

Related U.S. Application Data

(63) Continuation of application No. 11/143,063, filed on Jun. 2, 2005.

(51) Int. Cl.
*A43B 13/18* (2006.01)
*A43B 13/20* (2006.01)

(52) U.S. Cl. ..... 36/28; 36/29; D2/977

(58) Field of Classification Search ..... D2/977; 36/27, 28, 29, 31, 37, 78, 3 B, 25 R, 35 B, 36/2 A, 2 B, 2 R, 1.5, 72 R, 72 A, 131, 96
See application file for complete search history.

(56) References Cited

U.S. PATENT DOCUMENTS

| | | | | |
|---|---|---|---|---|
| 4,506,461 | A * | 3/1985 | Inohara | 36/29 |
| 4,782,603 | A * | 11/1988 | Brown | 36/29 |
| 4,999,931 | A * | 3/1991 | Vermeulen | 36/29 |
| 5,224,277 | A * | 7/1993 | Sang Do | 36/27 |
| 5,577,334 | A * | 11/1996 | Park | 36/28 |
| 5,887,359 | A * | 3/1999 | Falguere | 36/2 R |
| 6,782,641 | B2 * | 8/2004 | Turner et al. | 36/29 |
| 7,013,582 | B2 * | 3/2006 | Lucas et al. | 36/28 |
| 2004/0194344 | A1 * | 10/2004 | Tadin | 36/44 |

* cited by examiner

*Primary Examiner*—Jila M Mohandesi
(74) *Attorney, Agent, or Firm*—Warner Norcross & Judd LLP

(57) ABSTRACT

A sole for an article of footwear having an insert that includes a slot for receiving a gaiter strap. In one embodiment, the insert includes a plurality of support tubes that include internal webs configured to control the support characteristics of each support tube. In one embodiment, a first plurality of support tubes is disposed along the medial side of the sole in the heel region and a second plurality of support tubes is disposed along the lateral side of the sole in the heel region. The insert may include an arch portion that extends through and provides support to the arch region of the sole. The arch portion may define a slot to receive a gaiter strap. The insert may further include a forefoot extension that extends forwardly from the arch along the medial side of the sole. In one embodiment, the sole may include a heel wedge disposed below the insert in the heel region such that the support tubes are supported upon a relatively resilient material. In one embodiment, the insert may include struts that interconnect the medial and lateral support tubes.

16 Claims, 13 Drawing Sheets

FOOTWEAR SOLE

BACKGROUND OF THE INVENTION

The present invention relates to footwear, and more particularly to a sole construction for an article of footwear.

There is a continuing effort to provide ever more comfortable footwear. Running shoes, as well as other footwear, have undergone tremendous evolutionary advances in technology over the past 20 years. Many of the technological advances have occurred in the midsole. In most footwear, the mid sole functions as the "suspension system" of the sole and it often provides both protective cushioning and a stable platform for the wearer's foot. Variations in the characteristics of the midsole can have a dramatic affect on the performance of the shoe. In an effort to provide improved performance, it is often desirable to vary the support characteristics of the sole from one region to another. For example, it may be desirable to provide a higher density material in the heel and a lower density material in the forefoot. A higher density material in the heel provides greater support upon heel strike while a lower density material in the heel provides greater support upon heel strike while a lower density material provides appropriate cushioning and support for the typically smaller loads encountered in the forefoot. A wide variety of soles have been developed to provide variable support over the foot. In some applications, variable support is provided by forming different regions of the midsole from different materials, such as softer EVA foam in the forefoot and firmer EVA foam in the heel. In other applications, the sole is provided with a support plate that can be configured to provide the sole with the desired overall support profile. Although a marked improvement over conventional uniform sole constructions, there remains a need for a sole construction that is inexpensive to manufacture and that is highly tunable with a wide range of adjustability.

At the same time, there is also an ongoing effort to extend the life of footwear soles. In conventional footwear, the midsole (as well as the other sole components) may begin to lose its performance over a relatively short period of time. Degradation of the sole material can cause the sole to lose its resiliency over time, particularly in regions of high and repeated impact, such the heel. The rate of degradation will vary from sole to sole, but is largely dependent on the specific characteristics of the sole material and the types of loads applied to the sole. For example, conventional closed and open cell foams, such as EVA, have a relatively short life as the material naturally breaks down over relatively short periods of use. Conventional foam materials are also susceptible to temperature changes, which can cause the resiliency of the foam to vary noticeably softer in higher temperatures. As a result, temperature can have a significant adverse affect on the support characteristics of a sole manufactured from conventional foam materials.

Accordingly, there remains a need for a highly reliable, tunable sole that has an extended life and is relatively inexpensive to manufacture.

SUMMARY OF THE INVENTION

The aforementioned problems are over come by the present invention which provides a sole having an insert with a plurality of support tubes that are tuned to provide the desired support profile. Each support tube may include an internal web having an orientation that is selected to provide the desired support characteristics. By varying the orientation of the webs from support tube to support tube, the overall support profile of the sole can be controlled.

In one embodiment, the support layer is disposed between the outsole and the midsole. If desired, the sole may further include a heel wedge disposed between the outsole and the insert in the heel region. The heel wedge may be manufactured from a material that is firmer than the midsole material. As a result, the heel wedge may provide additional support in the heel region of the sole.

In another embodiment, the insert may include a plurality of support tubes on the medial (or inner) side of the sole and a plurality of support tubes on the lateral (or outer) side of the sole. The internal webs may be disposed in a more vertical orientation along the medial side of the sole to provide greater vertical support on the medial side of the sole. If desired, the orientation of the webs can vary from tube to tube. For example, the webs may be oriented in an increasingly more vertical direction moving from front to rear to provide increasingly more vertical support toward the rear of the heel. The support tubes on the medial side may be connected to the support tubes on the lateral side by struts. The struts may be concave to provide the heel with an inherent centering capability.

In yet another embodiment, the support tubes are disposed in at least a portion of the heel region of the insert and the insert includes an arch portion extending through the arch region of the sole. The arch portion of the insert may include two layers spaced apart from one another to provide a structure to receive a gaiter strap. The lower layer helps to protect the gaiter strap from damage associated with ground contact. If desired, the insert may further include a forefoot extension that extends through at least a portion of the forefoot region of the sole. The forefoot extension may extend only along the medial side of the forefoot region to provide a sole that is more rigid along the medial side. The forefoot extension may extend through different regions of the forefoot or may cover the entire forefoot region, as desired.

The present invention provides a unique footwear sole that can be easily tuned to provide the desired support profile. The insert may be manufactured from TPU or other relatively durable materials that do not degrade as quickly as conventional foam materials and therefore extend the cushioning life of the midsole. The support profile may be varied between the medial and lateral sides of the sole. For example, the support tubes on the medial side of the sole can be tuned to provide increasing vertical stiffness toward the back of the shoe, thereby address the problem of over pronation. The insert is relatively inexpensive to manufacture and its support characteristics can be readily adjusted by controlling, among other things, the nature and orientation of the support tubes and the webs. The insert can be combined with a heel wedge to provide even greater control over its support profile. The arch portion of the insert can be tuned to provide control over the support profile of the sole in the arch region. The gaiter slot can be incorporated into the arch portion to protect a gaiter strap from premature wear. The support profile of the sole in the forefoot region can be controlled through the use of the forefoot extension. When included, the struts assist in centering the foot on heel strike.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
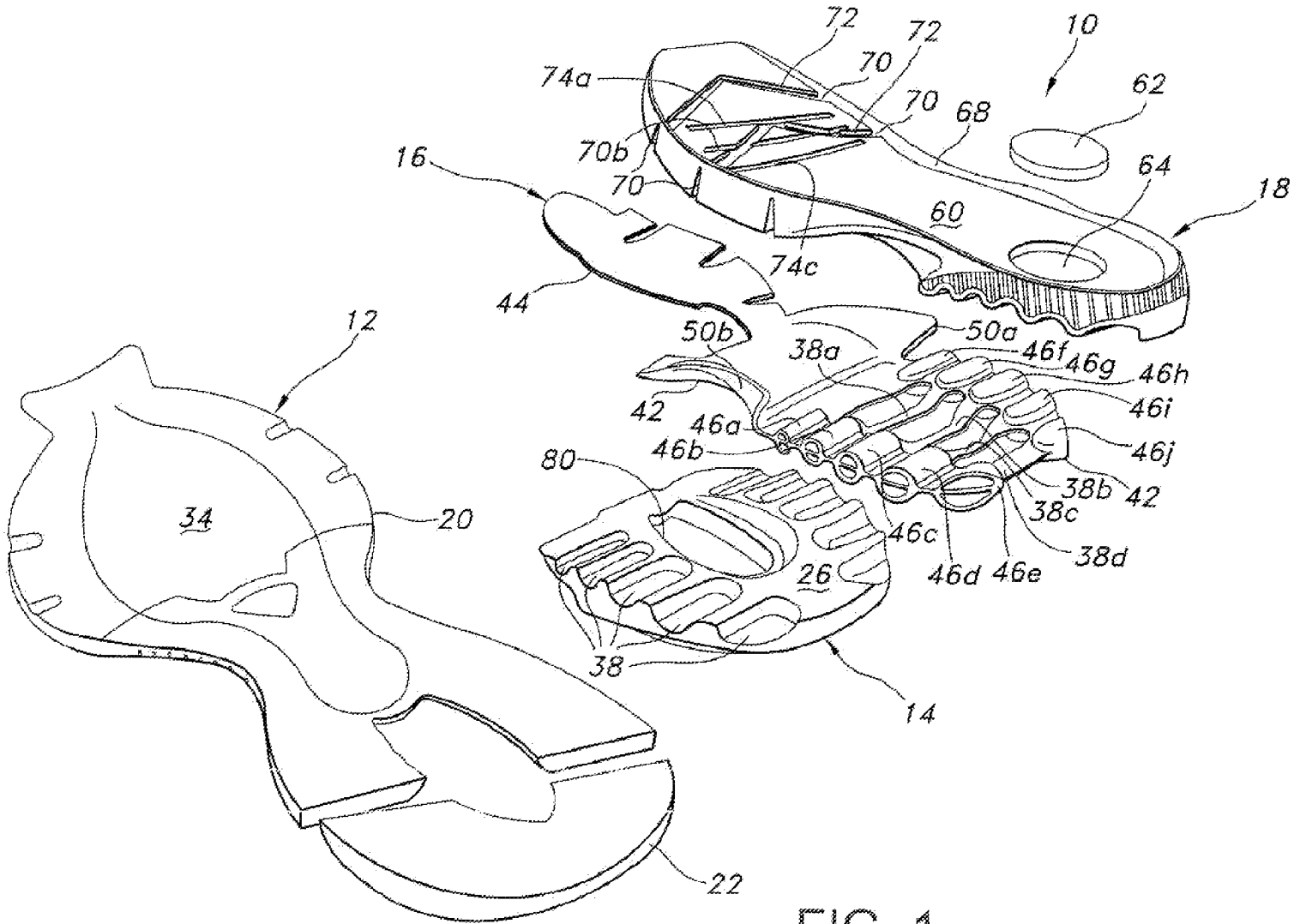
FIG. 1 is an exploded perspective view of a sole in accordance with an embodiment of the present invention.

A footwear sole manufactured in accordance with an embodiment of the present invention is shown in FIG. 1, and generally designated 10. The footwear sole 10 generally includes an outsole 12, a heel wedge, 14, an insert 16 and a midsole 18. The sole 10 may be incorporated into an article of footwear, such as shoe 200 shown in FIGS. 2. The shoe 200 may include an upper 202 that is affixed to the sole 10. The shoe 200 may also include a foot bed (not shown) that is removably fitted into the upper 202 atop of the sole 10. The insert 16 may include support tubes 46*a-j* with internal webs 48*a-j* that are configured to control the support profile of the sole 10. Although the present invention is described in connection with a conventional standard height running or trail running shoe 200, the present inventions not limited to use in shoes of that type. The present invention is well-suited for use in essentially any type of sole and can be incorporated into essentially any type of footwear. The footwear sole 10 is intended to be secured to an upper (not shown) using essentially any attachment construction, including without limitation cement, stitch, welt and direct attach constructions. The footwear sole 10 may also include a shank or other conventional sole components, as desired.

To facilitate disclosure of the present invention, reference will be made to various general areas of the foot, such as the heel, arch and forefoot area. When used to refer to locations on the various sole components, these terms should be interpreted to include those areas of the sole that are disposed generally (and not necessarily directly) beneath the corresponding elements of the foot. For purposes of general reference only, the heel area is generally defined as that area behind (toward the rear of the heel of the sole 10) phantom line A1 (See FIG. 2), the arch area is generally defined as that area between phantom lines A1 and A2 and the forefoot region is generally defined as that area ahead of (toward the tiptoe of the sole 10) phantom line A2. It should be understood, however, that the boundaries between the heel, arch and forefoot areas are not precise and that these terms should be interpreted loosely and with a great deal of flexibility.

Figure 12:
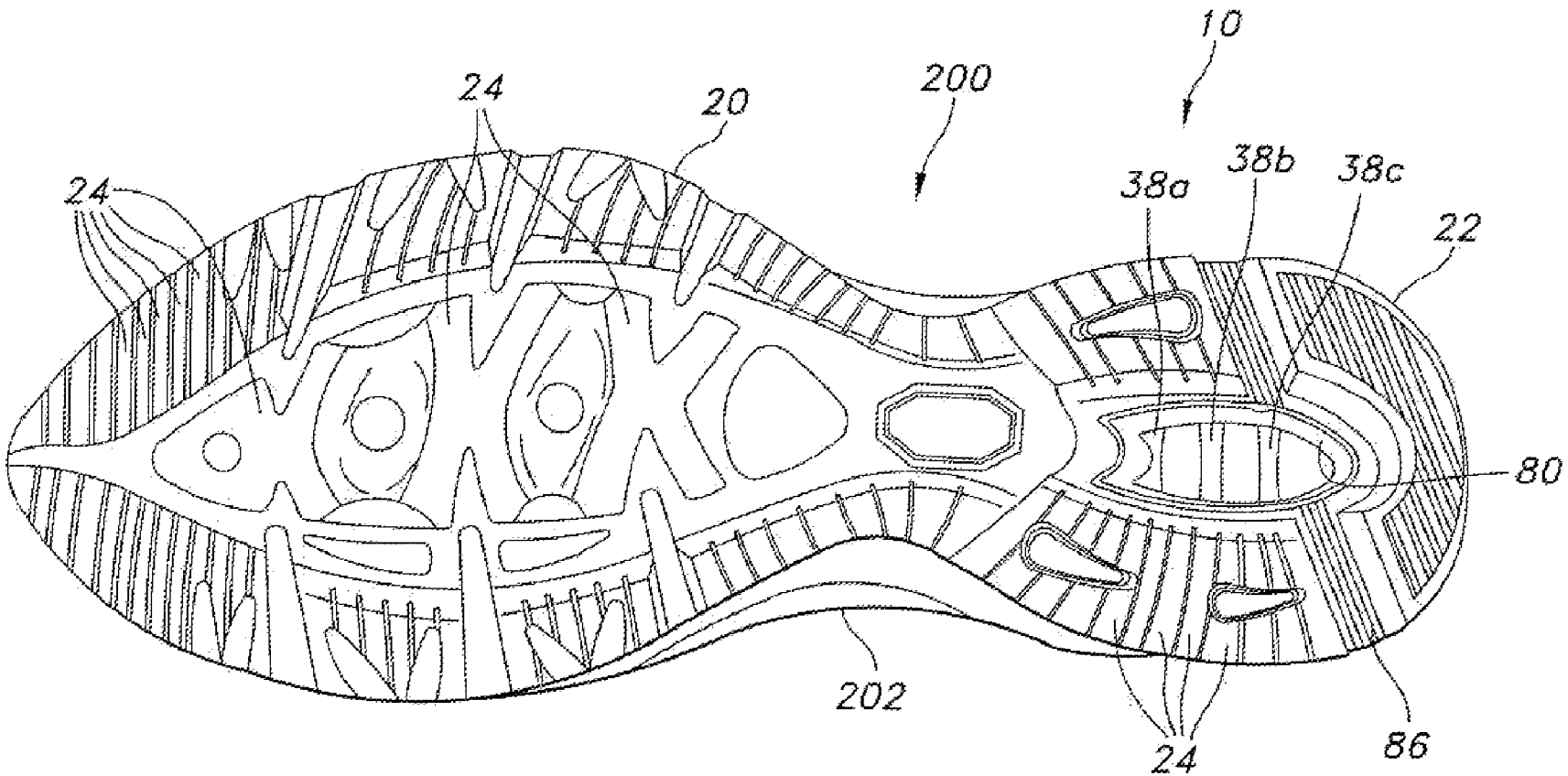
FIG. 12 is a bottom plan view of the shoe.

In the described embodiment, the outsole 12 is generally conventional and defines the primary wear surface for the sole 10. The outsole 12 is generally conventional and is secured to the bottom of the sole 10 to provide a durable and non-slip wear surface (See FIG. 2). The design and configuration of the outsole 12 may vary from application-to-application. However, in the illustrated embodiment, the outsole 12 is a two-piece outsole having a main part 20 and heel part 22 (See FIGS. 1 and 12). The main part 20 of this embodiment extends across portions of the heel wedge 14, insert 16 and midsole 18. The main part 20 is cemented or otherwise secured to the bottom of the various sole components 14, 16 and 18 using generally conventional techniques and apparatus. The heel part 22 is disposed at the back of the heel and is cemented to the undersurface of the heel wedge 14 using a generally conventional techniques and apparatus. Separation of the main part 20 and the heel part 22 provides the outsole 12 with a degree of articulation in the heel. The lower surface of each part 20 and 22 includes a plurality of lugs or other traction elements, which are generally identified in the drawings by reference numeral 24. The design and configuration of the traction elements 24 may vary from application to application as desired. The outsole 12 may be manufactured from a variety of conventional sole materials, such as natural and synthetic rubbers, leather, PVC, EVA and polyurethane.

Figure 2:
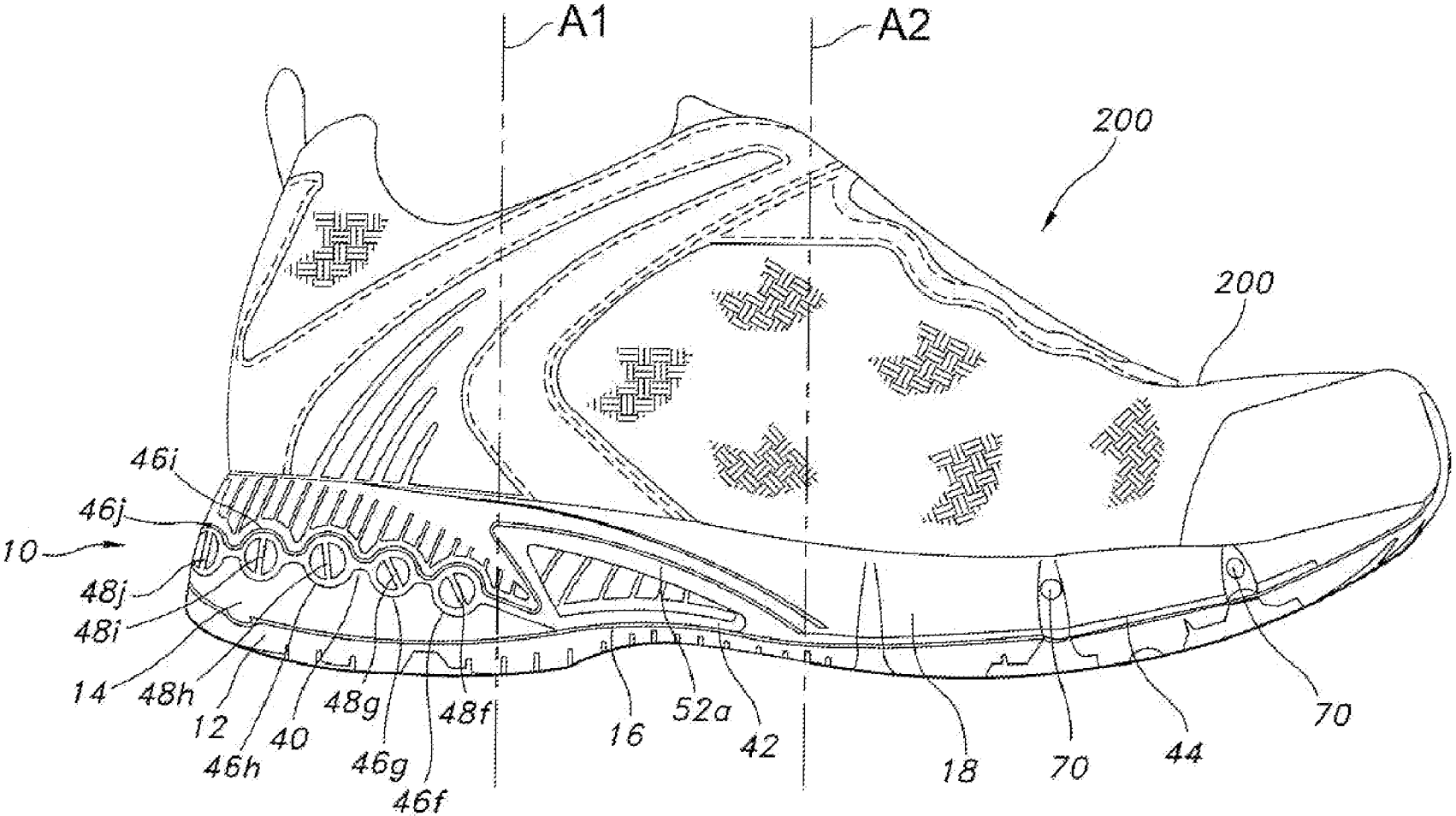
FIG. 2 is a medial side elevational view of the shoe.
Figure 9:
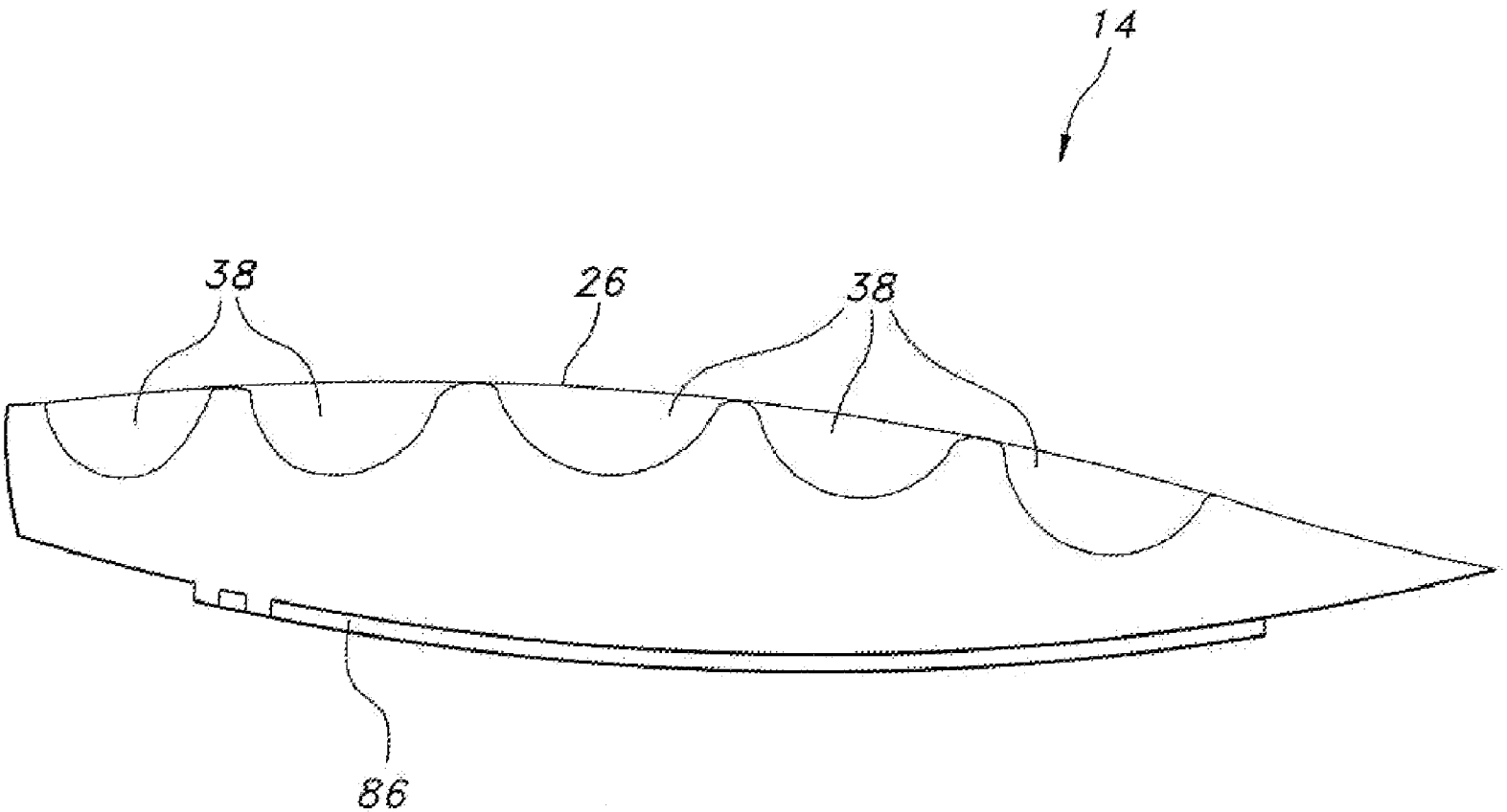
FIG. 9 is a side elevational view of the heel wedge.
Figure 10:
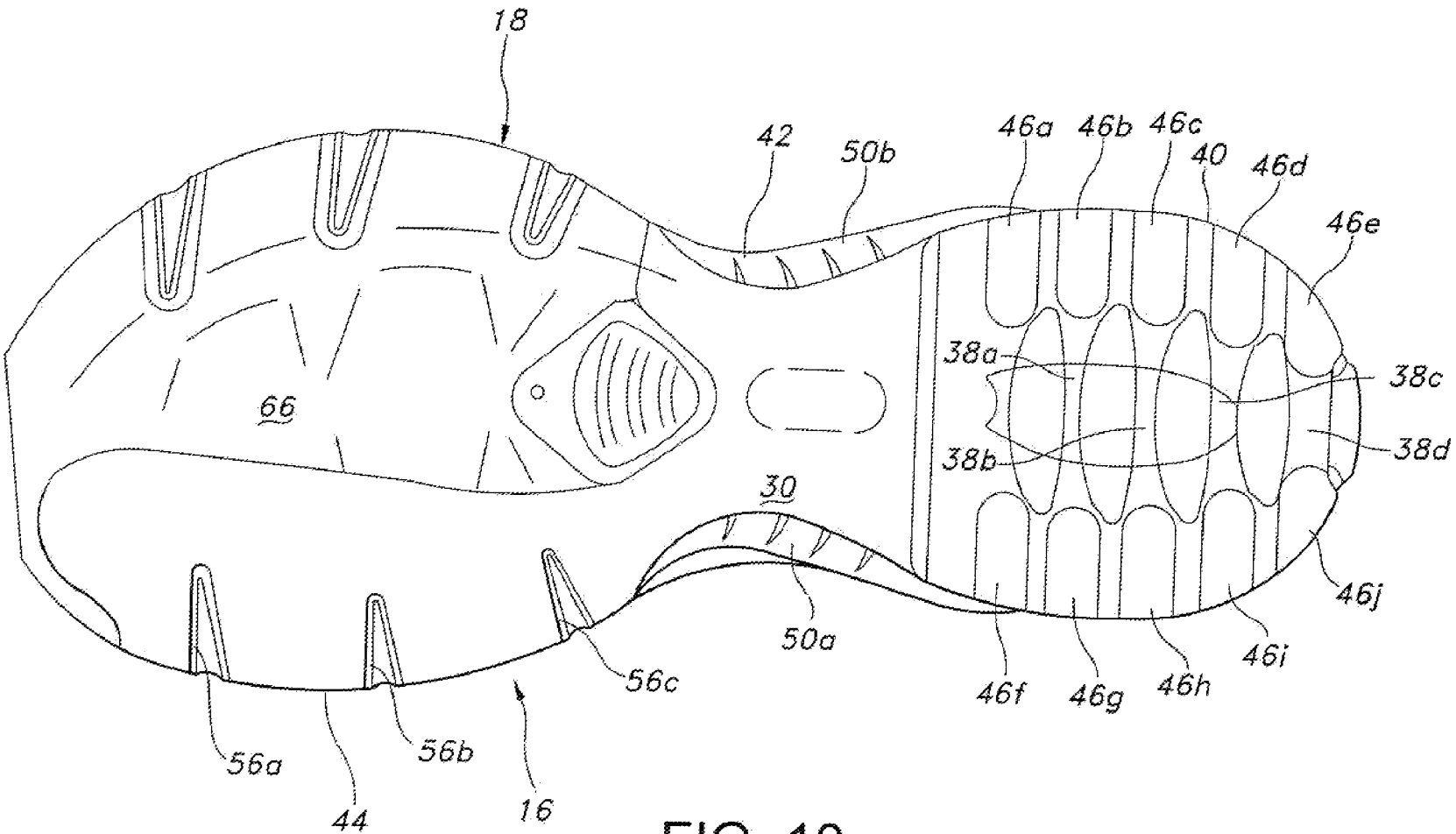
FIG. 10 is a bottom plan view of the insert and midsole.
Figure 11:
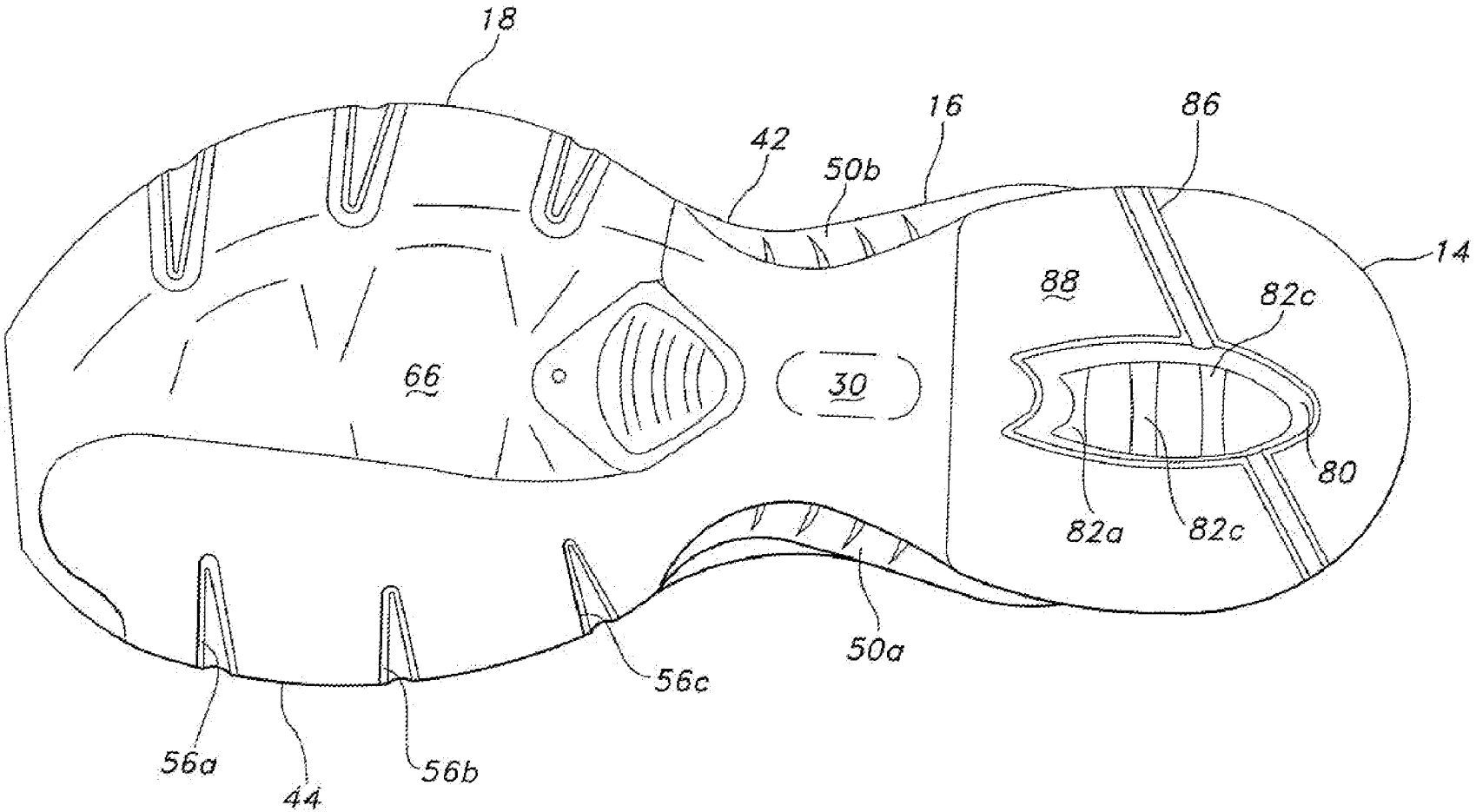
FIG. 11 is a bottom plan view of the insert, midsole and heel wedge.

As noted above, the sole 10 includes a heel wedge 14 disposed above the outsole 12 in the heel region (See FIGS. 1 and 2). The heel wedge 14 provides a resilient, compressible platform for the insert 16 as described in more detail below. Referring now to FIG. 9, the heel wedge 14 is generally wedge-shaped having an upper surface 26 that is contoured to compliment the shape of the bottom surface 30 of the insert 16 and a lower surface 32 that is contoured to compliment the shape of the upper surface 34 of the outsole 12. More specifically, the upper surface 26 of the illustrated embodiment includes a plurality of tube recesses 36*a-j* that corresponds in shape with the support tubes 46*a-j*. The tube recesses 36*a-j* closely receive the support tubes 46*a-j* in the assembled sole 10. The heel wedge 14 may be manufactured from a variety of sole material, such as EVA and polyurethane. In the illustrated embodiment, the heel wedge 14 defines a central opening 80 that is aligned with a corresponding absence of material in the heel region of the outsole 12. Among other things, the opening 30 permits viewing of portions of the midsole 16 and insert 18. As perhaps best shown in FIG. 11, the heel wedge 14 may include an arrangement of small ridges 86 on its undersurface 88 that, among other things provide a guide for placing the outsole 12 parts. In the illustrated embodiment, the heel wedge 14 extends only through the heel region of the sole 10 and is generally wedge-shaped. The heel wedge 14 may extend through the heel regions of the sole and may, for example, extend through the arch region or be coextensive with the entire sole. The heel wedge 14 is not necessarily wedge-shaped and may take on different thickness configurations as desired. In the illustrated embodiment, the heel wedge 14 is manufactured from EVA foam having a durometer value of approximately 55-60 Asker C. Scale. The type of material and density of the heel wedge 14 material may, however, vary from application to application. If desired, the density of the heel wedge 14 may vary from region to region within the heel wedge 14.

Figure 8A:
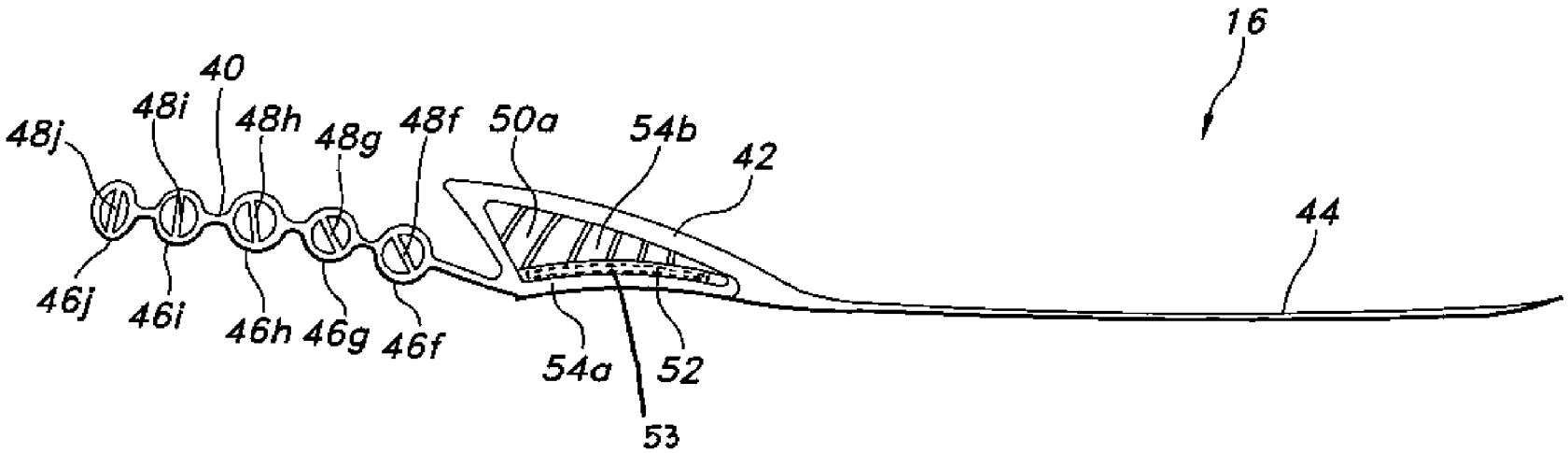
FIG. 8A is a right (medial) side elevational view of the insert.
Figure 8B:
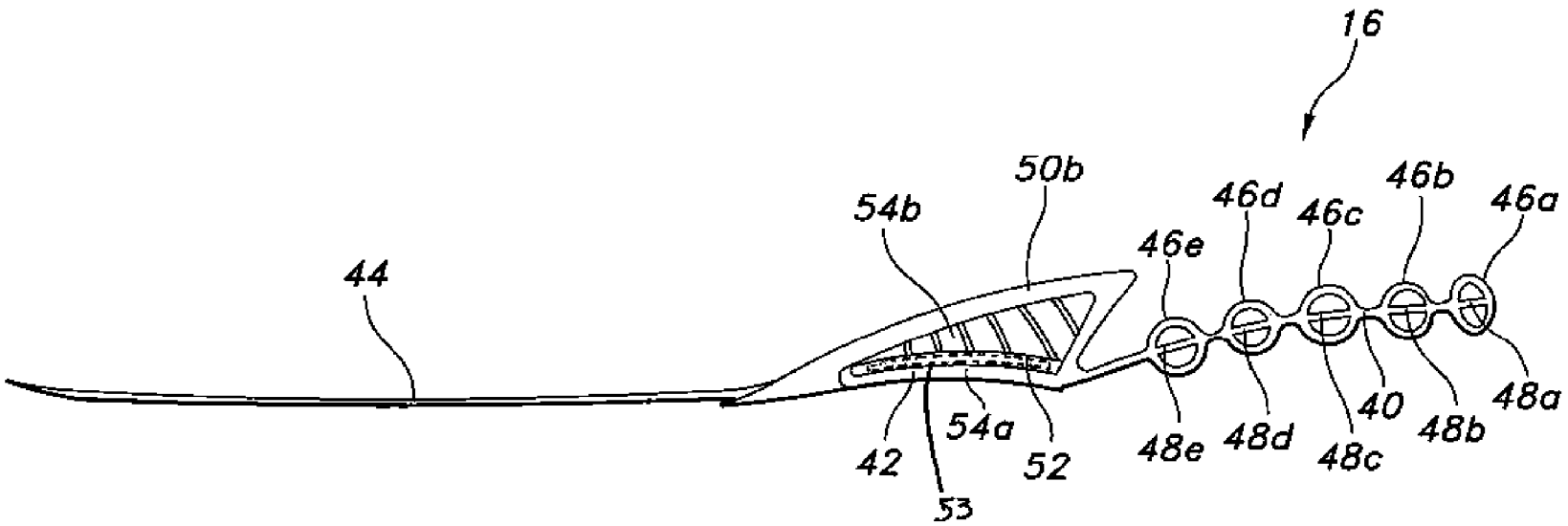
FIG. 8B is a left (lateral) side elevational view of the insert.

The insert 16 is disposed above the outsole 12 and the heel wedge 14, and provides the sole 10 with a highly tuned support profile (See FIGS. 1 and 2). Referring now to FIGS. 6, 8, 8A and 8B, the insert 16 generally includes a heel portion 40, an arch portion 42 and a forefoot extension 44. The heel portion 40, as its name implies, extends through at least a portion of the heel region of the sole 10 and includes a plurality of support tubes 46*a-j*. In the illustrated embodiment, the support tubes 46*a-j* extend in a generally lateral orientation. The insert 16 may include a first plurality of support tubes 46*a-e* extending through a peripheral marginal portion of the lateral side of the heel region ("lateral support tubes") and a second plurality of support tubes 46*f-j* extending through a peripheral marginal portion of the medial side of the heel region ("medial support tubes"). The medial support tubes 46*f-j* and lateral support tubes 26*a-e* may be spaced apart so that the support tubes 46*a-j* do not extend through the central region of the sole 10. The absence of support tubes 46*a-j* do not extend through the central region of the sole 10. The absence of support tubes 46*a-j* in the central region may provide a relatively soft center that helps to center the wearer'foot on the sole 10. The use of separate medial and lateral support tubes is not strictly necessary, and in some applications, the support tubes may be located only on one side or may extend entirely across the sole 10. In the illustrated embodiment, the support tubes 46*a-j* are generally annular in cross-section. The support tubes 46*a-j* may alternatively have other cross-sectional shapes (both regular and irregular), such as oval, square, rectangular and triangular. The characteristics of each support tube 46*a-j* may be varied to control its particular response to different loads. For example, the number, shape diameter, length and wall thickness of the support tubes 46*a-j* may be varied to tune the support characteristics of the sole 10. Each support tube 46*a-j* may also include an internal web 48*a-j* that affects the support characteristics of the tube 46*a-j*. In the illustrated embodiment (where the support tubes 46*a-j* are generally annular in cross-section), the webs 48*a-j* are chords, and more particularly extend along diameters of the support tube 48*a-j*. But, the characteristics of each web 48*a-j* may be varied to control its affect on the support characteristics. For example, the number, orientation, position, length and thickness of the webs 48*a-j* can be varied. In the illustrated embodiment, the lateral support tubes 46*a-e* each include a web 48*a-e* that extends in a generally horizontal direction following the general extent of the insert 16. Accordingly, the webs 48*a-e* have little affect on the rigidity of the lateral support tubes 46*a-e* in the vertical direction. In the illustrated embodiment, the orientation of the webs 46*f-j* of the medial support tubes 46*f-j* varies from front to rear. More specifically, the medial webs 48*f-i* are arranged at a more vertical orientation toward the rear of the heel region as can be seen in FIGS. 2 and 8A. As a result, the medial support tubes 46*f-j* provide increasingly more resistance to vertical compression toward the rear of the heel region. In the illustrated embodiment, the webs 48*a-j* are integrally formed with the support tubes 46*a-j*. This is not, however, strictly necessary and the webs 48*a-j* may alternatively be separately manufactured, for example, as inserts that are fitted into the support tubes 46*a-j*.

The insert 16 may also include a plurality of struts 28*a-d* that join the support tubes 48*a-d* on one side of the sole 10 with the support tubes 48*f*-I on the opposite side. The characteristics of the struts 28*a-d* may be varied to control the support characteristics of the sole 10. For example, changes in the number, width, thickness and shape of the struts 28*a-d* will impact the support characteristics of the insert 16. As shown, the struts 38*a-c* are of this embodiment are generally concave to follow a convex structure on the undersurface of the midsole 18. In this embodiment, the struts 38*a-c* are concave primarily to accommodate recess 64 and plug 62.

The arch portion 42 of the illustrated embodiment is integral with and extends from the heel portion 40. It may alternatively be a separate component. The arch portion 42 includes a pair of wings 50*a-b* that extend upwardly from its lateral and medial edges. The wings 50*a-b* may be cemented or otherwise secured to the midsole 18. In use, the wings 50*a-b* provide the midsole 18 with enhanced support in the arch region. The arch portion 42 may also define a slot 52 for receiving the strap of a gaiter 53, which is illustrated schematically in broken lines in FIGS. 8A and 8B. The arch portion 42 of the illustrated embodiment includes a pair of spaced apart layers 54*a-b* that cooperatively define the slot 52. The size, shape and configuration of the layers 54*a-b* may vary from application to application as desired. The arch portion 42 is optional and may be eliminated, if desired.

The forefoot extension 44 of the illustrated embodiment is integral with and extends from the arch portion 42. It may alternatively be a separate component. The forefoot extension 44 may extend only along a peripheral portion of the medial side of the sole 10 (as shown in the illustrated embodiment). It may, however, be designed to extend through essentially any portion of the forefoot region or over the entire forefoot region, if desired. The forefoot extension 44 may define a plurality of flex slots 46*a-c* configured to provide flex points. The forefoot extension 44 is optional and may be eliminated in some applications, as desired.

the insert 16 may be manufactured from a variety of conventional materials, but typically it will be manufactured from a material that is stiffer than the heel wedge 14 and/or midsole 18. For example, the insert 16 may be injection molded from TPU, TPR or PVC. The insert 16 may be manufactured from other materials, such as nylon, rubber, synthetic rubber or silicone, but it is likely that the insert 16 would not be manufactured by injection molding if any of those alternative materials was used. If desired, the insert 16 may be manufactured from a collection of different materials. For example, the arch portion 42 may be manufactured from a stiffer material than the heel portion 40.

In the illustrated embodiment, the support tubes 46*a-j* extend only through the heel region of the sole 10. In alternative embodiments, the support tubes 46*a-j* may in addition (or alternatively) extend through the arch and/or forefoot regions of the sole. The size, configuration, layout and other characteristics of the support tubes 46*a-j* may vary from region to region and from application to application.

Figure 4:
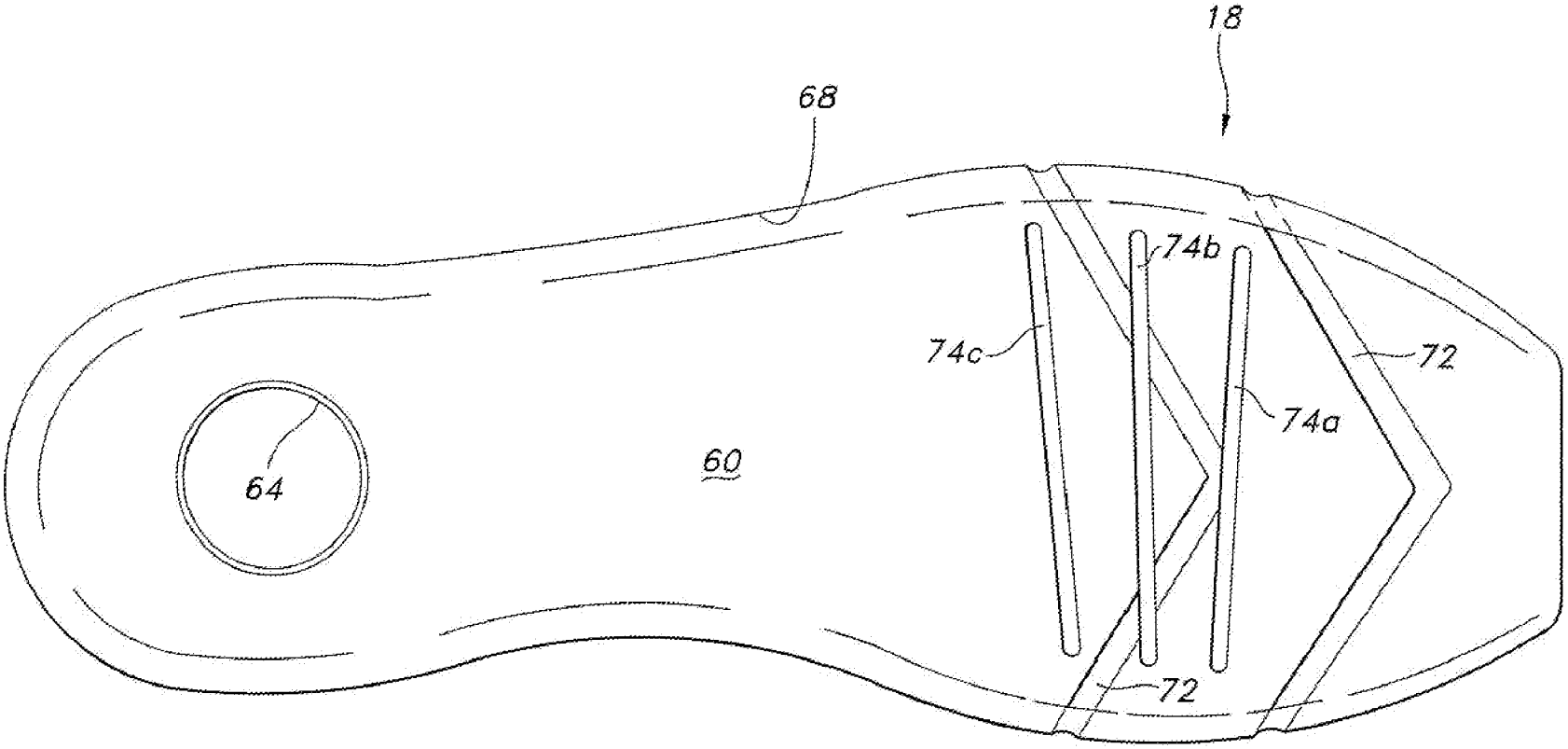
FIG. 4 is a top plan view of the midsole.

The midsole 18 is disposed between the insert 16 and the upper 202, and is designed to provide a compressible, resilient foot platform (See FIGS. 1 and 2). as it is designed to support the foot and to be incorporated into conventional footwear, the midsole 18 is generally foot-shaped. The midsole 18 may, however, take on other shapes, as desired, to accommodate various alternative sole designs. In the illustrated embodiment, the midsole 18 is manufactured from EVA foam having a durometer value of approximately 55-60 Asker C Scale. The type of material and density of the midsole 18 material may, however, vary from application to application. In the illustrated embodiment, the midsole 18 is a one-piece, unitary structure, but it may alternatively include a collection of separate elements that cooperatively support the foot. For example, in an alternative embodiment, the midsole 18 may include a forefoot segment that is manufactured from a relatively soft material and heel region manufactured from a more rigid material. The midsole 18 includes a generally smooth upper surface 60 designed to support the wearer's foot (See FIG. 4). The upper surface 60 may include contours, if desired. For example, the upper surface 60 of the midsole 18 may be contoured to match the natural contours of the wearer's foot, for example, by providing the upper surface 60 with a concave heel area, a raised arch area or essentially any other desired shape. The midsole 18 of the illustrated embodiment includes a peripheral lip 68 that extends upwardly around the peripheral edge of the midsole 18. The midsole 18 may directly engage the undersurface of the wearer's foot. In most applications, however, an additional component (not shown) will be incorporated into the sole 10 above the midsole 18. For example, an insole (not shown), sock liner (not shown), footbed (not shown) or other sole element may be incorporated into the sole 10 above the midsole 18. This additional component may be removably fitted into the shoe 200 atop the sole 10.

In the illustrated embodiment, the midsole 18 includes a disc-shaped plug 62 that is fitted into a corresponding recess 64 in the heel area (See FIG. 1). The plug 62 is manufactured from a relatively soft cushioning material, such as closed cell foam. In the illustrated embodiment, the plug 62 is manufactured from a material having a lower density that the material of the midsole 18. As a result, the plug 62 and recess 64 combination help to center the foot in the heel of the sole 10. The size, shape and configuration of the plug 62 and recess 64 may vary from application to application. For example, the plug 62 and recess 64 combination may be replaced by one or more perforations or cutouts that reduce the resistance of the corresponding region to compression. In this embodiment, the recess 64 is vertically aligned with the convex region of the struts, but that is not strictly necessary.

Figure 3:
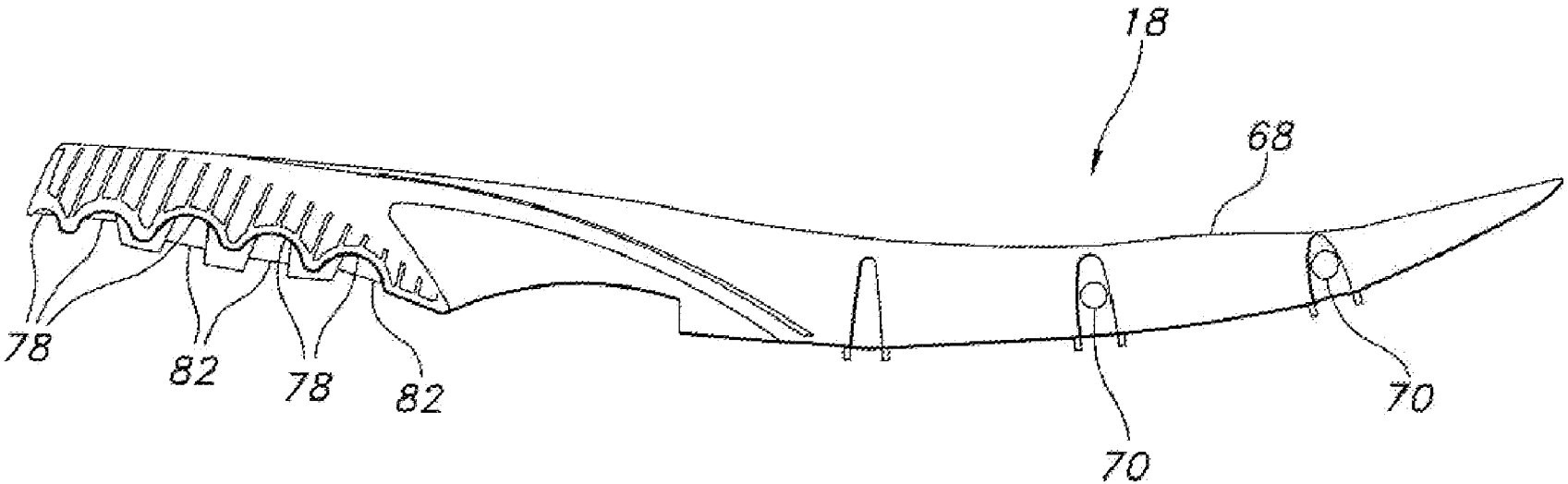
FIG. 3 is a side elevational view of the midsole.

The midsole 18 may be configured to provide ventilation as shown in the illustrated embodiment. In this embodiment, the midsole 18 defines a plurality of ventilation holes 70 through the sidewall of the midsole 18 and a series of ventilation channels 72 in the upper surface 60 of the midsole 18 (See FIG. 4). The ventilation channels 72 communicate with the ventilation holes 70 to permit air and water to ventilate through the midsole 18 (See FIG. 3) Again, this is optional and the present invention may be incorporated into a non-ventilated midsole as desired.

Referring again to FIG. 4, the midsole 18 may also include a plurality of flex grooves 74*a-c* to facilitate flexing of the midsole 18. In the illustrated embodiment, the midsole 18 includes flex grooves 74*a-c* extending substantially laterally across the sole 10 in the forefoot region. If desired, the flex grooves 74*a-c* may be eliminated or replaced by other structure intended to improve flexibility. For example, the flex grooves 74*a-c* may be replaced by a relatively shallow recess (not shown) in the top surface of the midsole 18 that is filled with a pad (not shown). The pad may have a lower density than the material of the midsole 18. The pad may be cemented within the recess.

Figure 5:
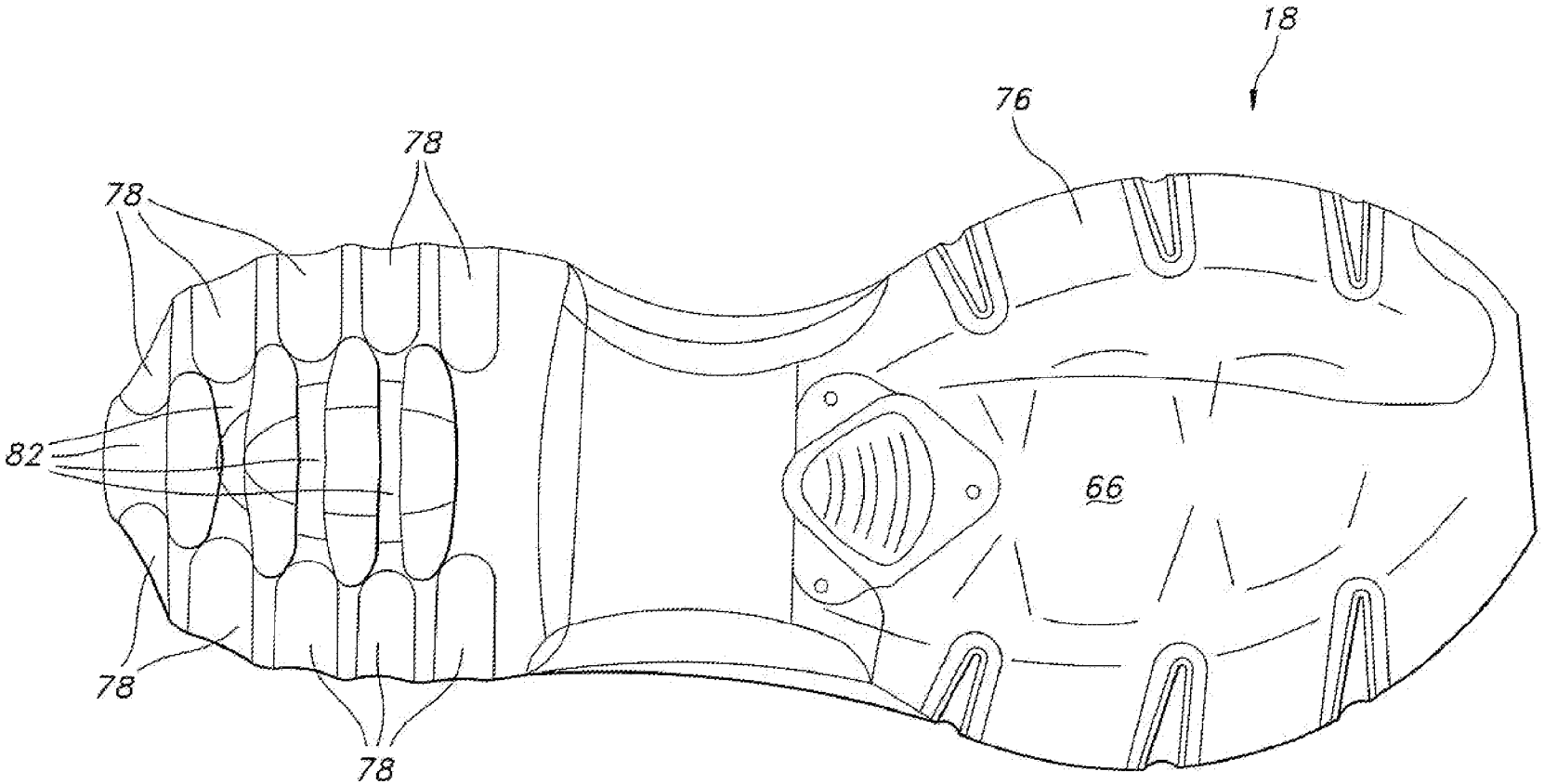
FIG. 5 is a bottom plan view of the midsole.
Figure 6:
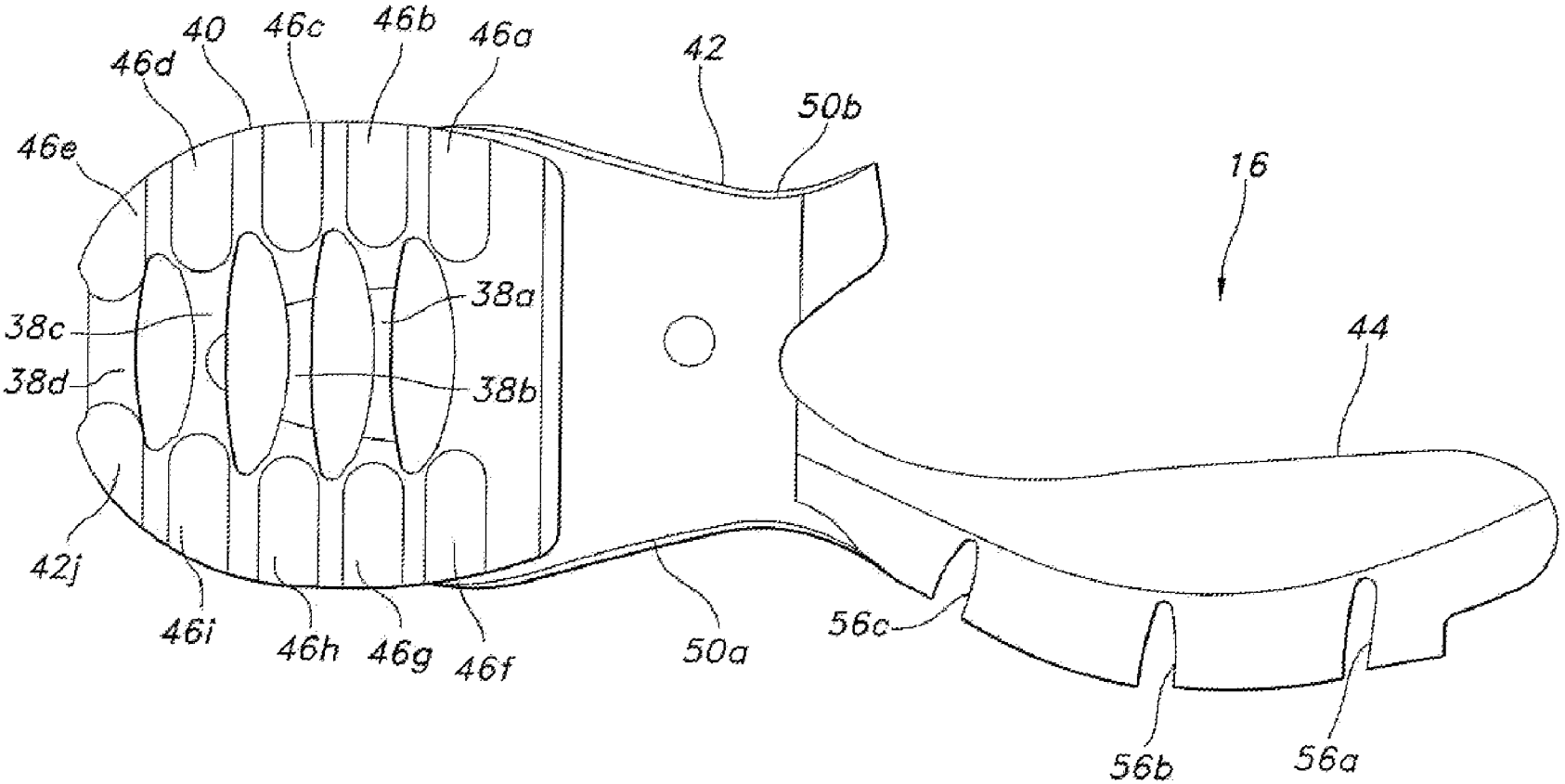
FIG. 6 is a top plan view of the insert.
Figure 7:
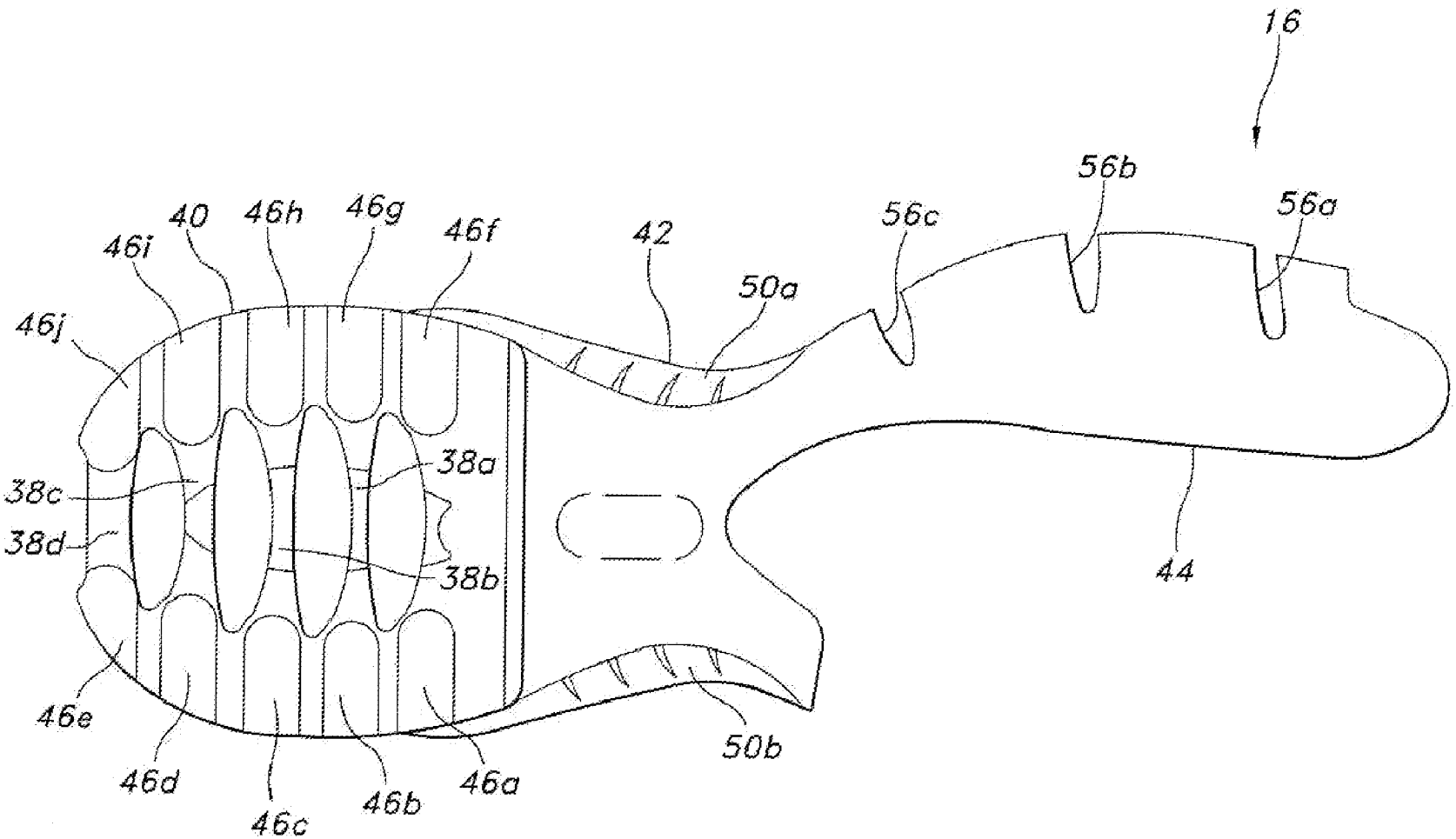
FIG. 7 is a bottom plan view of the insert.

The undersurface 66 of the midsole 18 may be contoured to compliment the shape of the outsole 12, heel wedge 14 and insert 16 (See FIG. 5). In the illustrated embodiment, the undersurface 66 of the midsole 18 contoured to define a plurality of support tube recesses 78 that are adapted to closely receive the support tubes 46*a-j* of the insert 16. If desired, an insert recess 76 may be defined in the undersurface 66 so that the insert 16 can be recessed or insert into the midsole 18. For example, the midsole 18 may define a plurality of strut recesses 82 adapted to receive the struts 38*a-d* of the insert 16. The recess 76 may also extend through the extents of the arch portion 42 (including the wings 50*a-b*) and forefoot extention 44. Alternatively (or in addition), recesses (not shown) may be formed in the top surface of the outsole 12 to receive all or a portion of the insert 16.

The midsole 18 and heel wedge 14 are separate components in the illustrated embodiment. The present invention extends, however, to applications in which the midsole and heel wedge are integral. For example, in an alternative embodiment, the appropriate material (e.g. EVA foam) may be injected or poured into a mold about the insert to entrap the insert in a single piece midsole/heel wedge combination.

The above description identifies certain approximate durometer values for the various components of the sole 10 of the illustrated embodiment. The recited values are merely exemplary and the present invention is not limited to sole constructions with the specific recited durometer values. To the contrary, the present invention should be broadly interpreted to extend to sole components having different compressibility values.

The above description is that of various embodiments of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A footwear assembly comprising:

an upper;

a footwear sole including an outsole and an insert, said insert positioned between said upper and said outsole, said insert having a lateral side and a medial side, said insert defining a slot extending from said lateral side to said medial side, said slot including a generally planar upper wall and a generally planar lower wall, said upper wall uniformly spaced from said lower wall; and a gaiter strap extending through said slot.

2. The footwear assembly of claim 1 wherein a portion of said insert includes an upper layer and a lower layer, upper and lower layers spaced apart to define said slot.

3. The footwear assembly of claim 2 wherein said lower layer includes an upper surface and a lower surface, said lower surface attached to said outsole.

4. The footwear assembly of claim 3 including a midsole positioned between said upper and said insert, and wherein said upper layer includes an upper surface and a lower surface, said upper surface of said upper layer attached to said midsole.

5. The footwear assembly of claim 4 wherein said insert includes an arch portion said slot positioned in said arch portion.

6. The footwear assembly of claim 5 wherein said arch portion includes a first wing extending upwardly from said lateral side and a second wing extending upwardly from said medial side.

7. The footwear assembly of claim 6 wherein the insert is a single, unitary molded piece.

8. The footwear assembly of claim 7 wherein said insert includes a heel portion, said heel portion defining a plurality of support tubes.

9. An article of footwear comprising:

an arch portion defining a slot for receiving the strap of a gaiter; and a heel portion, said heel portion including a plurality of rear support tubes, each of said rear support tubes including an internal web extending at an orientation, said orientation of at least one web varying from said orientation of at least one other web; and a gaiter strap extending through said slot.

10. The insert of claim 9 wherein said arch portion includes an upper layer and a lower layer, said upper and lower layers uniformly spaced apart to define said slot.

11. The insert of claim 10 further comprising:

an outsole; and a heel wedge disposed above and connected to said outsole at least in said heel region, said insert disposed above and connected to said heel wedge.

12. The insert of claim 11 wherein said insert includes a forefoot extension, said forefoot extension integral with and extending from said arch portion.

13. The insert of claim 12 wherein said heel portion, said arch portion and said forefoot extension are molded as a single unitary piece.

14. A method for securing a gaiter to an article of footwear, comprising:

providing an article of footwear including an upper and an outsole;

providing an insert between the upper and the outsole, the insert having a lateral side and a medial side, the insert defining a slot extending through the insert from the lateral side to the medial side; and passing a gaiter strap through the slot such that the strap extends beneath the upper and above the outsole.

15. The method of claim 14 wherein insert includes an arch portion located in an arch region of the article of footwear, and wherein the slot is positioned within the arch portion.

16. The method of claim 15 including a portion of the outsole extending into the arch region of the article of footwear, the slot defined by spaced apart upper and lower layers, the lower layer attached to the outsole.

* * * * *